US005435353A

United States Patent [19]

Bourgeaux

[11] Patent Number: 5,435,353

[45] Date of Patent: Jul. 25, 1995

[54] JACQUARD SYSTEM WTIH DIFFERENTIATED KNIFE STROKES TO FORM AN OBLIQUIE SHED

[75] Inventor: Pierre Bourgeaux, Poisy, France

[73] Assignee: S.A. Des Etablissements Staubli, Faverges, France

[21] Appl. No.: 219,906

[22] Filed: Mar. 30, 1994

[30] Foreign Application Priority Data

Apr. 7, 1993 [FR] France ..... 93 04347

[51] Int. Cl.[6] ..... D03C 3/32

[52] U.S. Cl. ..... 139/59

[58] Field of Search ..... 139/59, 65, 61, 62, 139/63, 64

[56] References Cited

U.S. PATENT DOCUMENTS 4,936,352 6/1990 Keim ..... 139/59

FOREIGN PATENT DOCUMENTS 4-73237 3/1992 Japan ..... 139/59

519021 3/1940 United Kingdom ..... 139/59

*Primary Examiner*—Andrew M. Falik

*Attorney, Agent, or Firm*—Dowell & Dowell

[57] ABSTRACT

In a Jacquard system, in order to form an oblique shed necessary for the weaving of ribbon-like articles drums whose diameters decrease from one end of the system to the other are provided. The drums are used for driving the runs of funicular elements which bear the knives for actuating the hooks of the modules which house the cords for vertical control of the warp yarns. The drums are driven with oscillating movement by two longitudinal connecting rods.

12 Claims, 2 Drawing Sheets

JACQUARD SYSTEM WTIH DIFFERENTIATED KNIFE STROKES TO FORM AN OBLIQUIE SHED

BACKGROUND OF THE INVENTION

The present invention relates to a Jacquard system for a weaving loom having differentiated strokes.

HISTORY OF THE RELATED ART

For producing names, designs or other informative or decorative patterns on the selvedges of fabrics being woven, small Jacquard systems (sometimes called "jacquarettes") are known, which comprise a reduced number of movable hooks for controlling the cords of a harness of a small size.

Reference may advantageously be made to French Patent 2 677 380 (STAUBLI) which shows the arrangement of a system of this type, in which the actuating hooks of the same row are controlled by means of two knives secured to a funicular member which is reciprocated and is guided by pulleys disposed so as to create parallel runs moving oppositely to form supports for the said knives.

For weaving selvedges, i.e. articles which include a harness of small size, a single stroke may be used for all the hooks without major drawback. However, when it is desired to produce ribbons or other articles for which weaving requires a number of cords, an oblique shed, having differentiated strokes is required for the different hooks of the system.

In such a case, the usual small Jacquard systems, or "jacquarettes", are obviously not suitable and conventional systems comprising a large number of hooks must be employed.

It is an object of the present invention to overcome this drawback, by providing a system of the general type described in French Patent 2 677 380, but in which the funicular members which carry the knives for controlling the actuating hooks are moved by a stroke which decreases parallel to the plane of displacement of the warp yarns.

SUMMARY OF THE INVENTION

According to the invention, drums which reciprocate drive the funicular members supporting the control knives have decreasing diameters. The reciprocating rotation of these drums is effected with the aid of the same longitudinal members which are moved by the oscillating movement and which is connected to each of the drums to be driven.

BRIEF DESCRIPTION OF THE DRAWINGS

The invention will be more readily understood on reading the following description with reference to the accompanying drawings, in which.

DESCRIPTION OF PREFERRED EMBODIMENT

Figure 1:
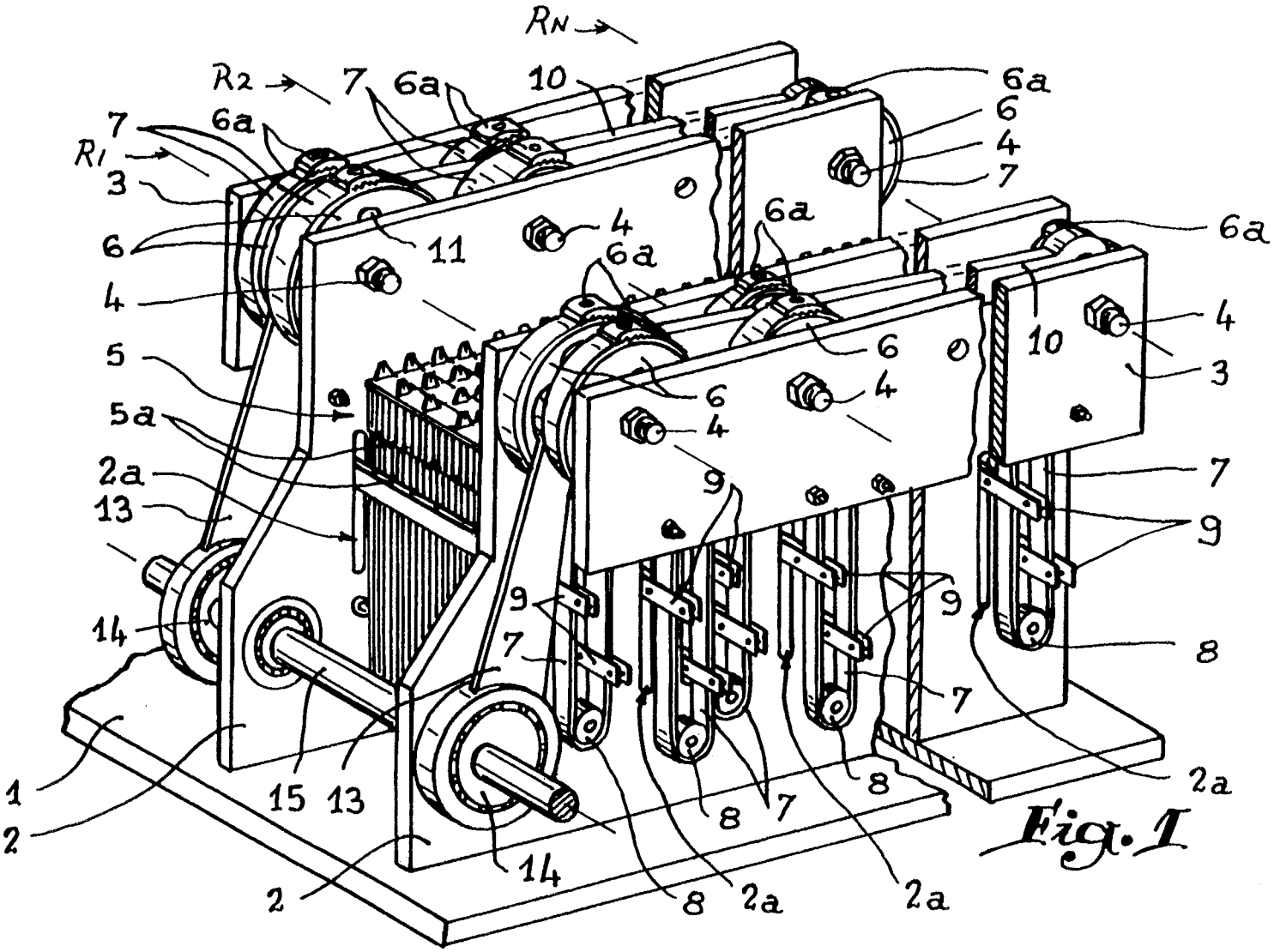
FIG. 1 shows in perspective the general arrangement of a system according to the invention.

Referring now to the drawings, the frame of the system shown in FIG. 1 comprises a lower base 1 secured with two vertical side elements 2 which are oriented parallel to each other. To each side element 2 is attached an upper plate 3 which extends parallel to the side element shown and which is fixed thereto with the aid of transverse assembly rods 4. Between the two side elements are mounted modules 5 for actuating, with the aid of mobile hooks 5*a* provided on the opposite faces of the modules, the cords intended for vertical control of the warp yarns. These modules 5, which are preferably of the type described in French Patent 2 586 432 (STAUBLI-VERDOL), are disposed side by side in a series of parallel rows oriented transversely to the axis of the side elements 2.

That part of each assembly rod 4 which is between the opposite faces of a side element 2 and a plate 3 is machined in order to form support for two drive drums 6 which are disposed side by side. The system is thus provided with two longitudinal series of sets or pairs of drums 6.

On each drum 6 are secured, with the aid of a clip 6*a*, the ends of a funicular member such as a belt 7 which is guided by a pulley 8 to wind around the periphery of the drum and which defines two vertical runs. The "skid pulleys are mounted from the outer face of the side elements 2 so as to be plumb with the drums shown.

As in French Patent 2 677 380, on each of the vertical runs of the two belts 7 which cooperate with the two outer and inner drums, respectively, which face each other to correspond to the same rows of modules 5, there are secured two horizontal knives 9 which cooperate with the projecting hooks 5*a* of said modules. The knives 9 are engaged in vertical slots 2*a* in the side elements 2. It will be appreciated that it suffices to impart to the drums 6 a reciprocating movement of rotation about the rods 4 for the knives 9 to be moved by a vertical reciprocating movement adapted to ensure control of the hooks 5*a* of the assembly of the modules 5 of the system.

Figure 2:
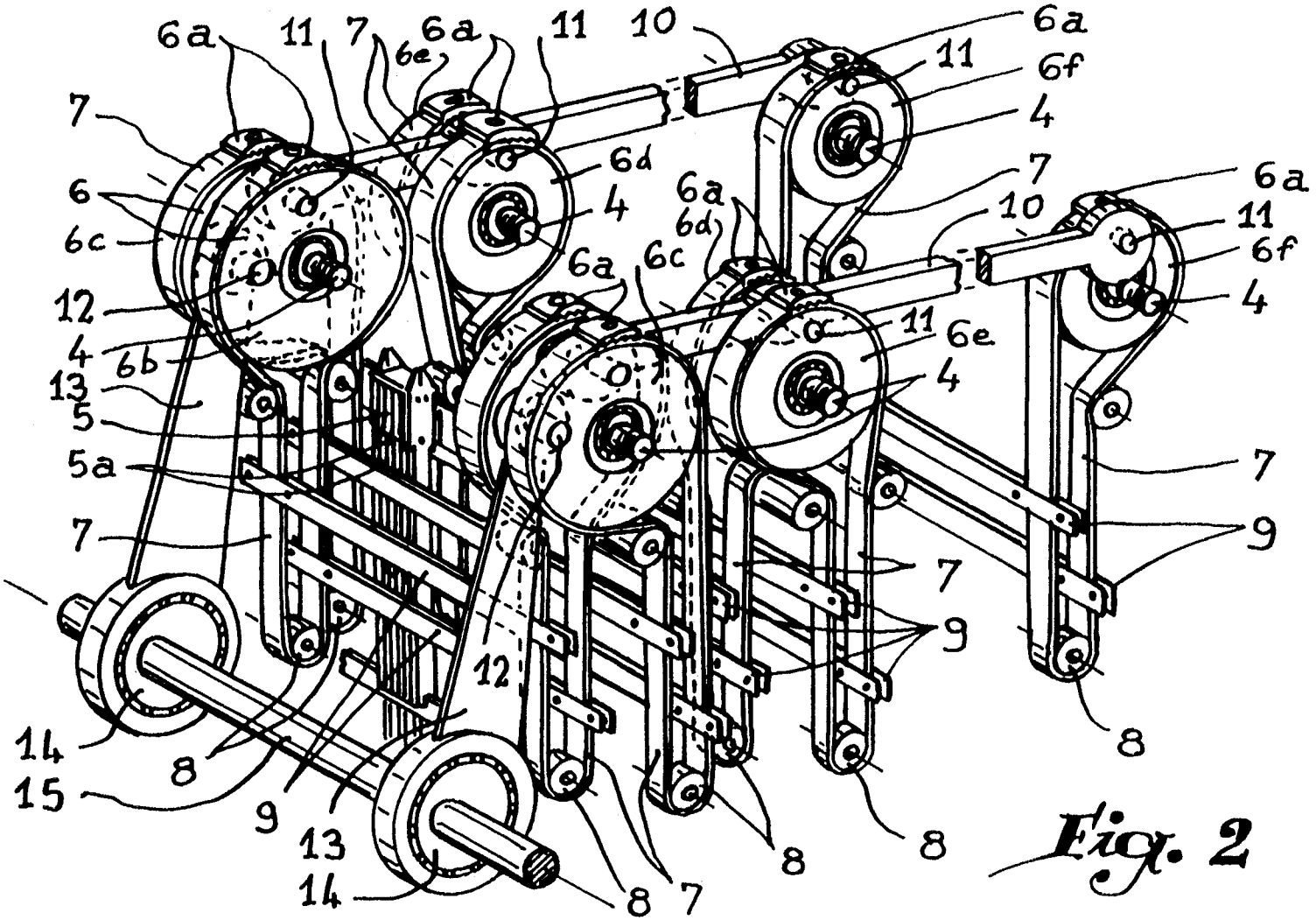
FIG. 2 is a view similar to FIG. 1, without the fixed frame, in order to show the drive device more clearly.

It should be observed here that the diameters of the different drums 6 of the system decrease from one end thereof to the other. The two inner drums 6*b* of the first row of modules R1 have a diameter slightly greater than that of the two outer drums 6*c* and the two outer drums 6*c* have a larger diameter than the two inner drums 6*d* corresponding to the second row R2, the two inner drums 6*d* having a greater diameter than the two outer drums 6*e* of row R2 and the two outer drums 6*e* having a larger diameter than the next row of drums until the single drums 6*f* of a last row Rn of drums, as shown in FIGS. 1 and 2.

Under these conditions, it will be understood that the amplitude of the vertical stroke of the knives 9 will decrease from one end of the system to the other, and this even in the case of the drums 6 being moved by an angular displacement of the same amplitude. Consequently, the desired oblique shed is created, adapted to enable articles of ribbon and like type to be produced.

According to another noteworthy feature of the system shown, oscillating drive of the drums 6 is effected with the aid of two longitudinal connecting rods 10 which are housed in the space defined between each side element 2 and a plate 3, i.e. between the two drums 6 mounted on each of the assembly rods 4. Each connecting rod 10 is coupled at 11 to the drums of each of the sets of drums. The radial distance between each rod 4 and the point of coupling 11 is identical for all the drums 6, as well as the angle of inclination of the line between the two points of connection.

On each of the two sets of drums 6 of largest diameter, there is articulated at 12 the end of a vertical crank arm 13 of which the lower end is a ring connected to an eccentric 14. The two eccentrics 14 are fitted on the same shaft 15, rotated by an appropriate motor (not shown).

An equivalent result may be obtained by replacing the connecting rods 10 by two racks cooperating with toothed pinions secured to the drums 6 of each set, and by reciprocating the racks with a longitudinal movement, for example a jack or other appropriate drive means.

It must, moreover, be understood that the foregoing description has been given only by way of example and that it in no way limits the domain of the invention which would not be exceeded by replacing the details of execution described by any other equivalents. In particular, the group, in the form of modules, of the hooks for actuating the cords is not indispensable, to being possible to mount hooks 5*a* being in any appropriate manner.

What is claimed is:

1. In a jacquard system for a weaving loom having a plurality of knives spaced from one another from one end of the system to the other which are used for reciprocating rows of hooks associated with cords for controlling warp yarns, the improvement comprising, a plurality of spaced funicular members having runs which are generally parallel with one another, the knives being carried by said runs of said funicular members, a plurality of drums spaced from one another from the one end of the system toward the other, means for driving said drums in a reciprocating motion, said funicular members being mounted so as to be reciprocally driven by said drums, said drums having diameters which decrease relative to one another in spaced relationship from the one end of the system to the other whereby the funicular members and thus the knives and hooks have differentiated reciprocating movement.

2. The jacquard system of claim 1 in which said means for driving said drums includes a connecting rod, coupling means connecting said connecting rod to said drums, and means for moving said connecting rod in an oscillating motion.

3. The jacquard system of claim 2 in which said means for moving said connecting rod in an oscillating motion includes a crank arm having a first end connected to one of said drums and a second end connected to an eccentric driving member.

4. The jacquard system of claim 3 in which said drums are mounted in spaced pairs to thereby form spaced generally parallel said drums of each pair of drums having a diameter greater than rows of drums from one end of the system toward the other, one of that of the other of each pair of drums.

5. The jacquard system of claim 4 in which a plurality of said spaced rows of drums include first and second spaced pairs of drums, a first of said drums of each of said first and second pairs of drums in the same row having the same greater diameter, said first of the drums being connected to a first pair of said funicular members to which are mounted a first pair of spaced knives, and a second of said drums of each of said first and second pairs of drums having the same diameter and being connected to a second pair of said funicular members to which are mounted a second pair of spaced knives.

6. The jacquard system of claim 5 including first and second connecting rods, first coupling means for connecting said first connecting rod to said first pairs of drums, and second coupling means for connecting said second connecting rod to said second pairs of drums, and means for moving each of said first and second connecting rods in an oscillating motion.

7. The jacquard system of claim 3 wherein the knives are mounted to said runs of said funicular members so as to reciprocate between a pair of opposing plates, said drums being mounted as closely spaced pairs of drums in two symmetrical longitudinal series of pairs of drums which are spaced relative to one another from the one end of the system to the other end, one of said series of said pairs of drums being mounted to a first of said plates and the other of said series of said pairs of drums being mounted to a second of said plates, and said first and second series of said pairs of drums being aligned to form a plurality of spaced rows of drums which rows extend generally perpendicularly with respect to said opposing plates.

8. The jacquard system of claim 7 including connecting rods extending between each of said pairs of drums on each of said plates, said coupling means connecting each of said pairs of drums to said connecting rods.

9. The jacquard system of claim 7 in which the diameter of one of said drums of each of said pairs of drums is greater than the diameter of the other of said drums of each of said pairs of drums.

10. The jacquard system of claim 9 in which said diameter of said pairs of drums along a first row of drums is greater than the diameter of said pairs of drums along each subsequent row from the one end to the other end of the assembly.

11. The jacquard system of claim 1 in which said drums are mounted in spaced pairs to thereby form spaced generally parallel rows of drums from one end of the system toward the other, one of said drums of each pair of drums having a diameter greater than that of the other of each pair of drums.

12. The jacquard system of claim 11 in which a plurality of said spaced rows of drums include two spaced pairs of drums, a first of said drums of each pair of drums in the same row having the same greater diameter, said first of the drums being connected to a first pair of said funicular members to which are mounted a first pair of spaced knives, and a second of said drums of each pair of drums having the same diameter and being connected to a second pair of said funicular members to which are mounted a second pair of spaced knives.

* * * * *